US005657995A

United States Patent [19]

Howard

[11] Patent Number: 5,657,995

[45] Date of Patent: Aug. 19, 1997

[54] LEAPING FISH GAME AND TRAINING AID

[76] Inventor: Michael F. Howard, 2626 N. Woody, Boise, Id. 83703

[21] Appl. No.: 690,009

[22] Filed: Jul. 31, 1996

[51] Int. Cl.[6] ..... A63B 69/00; A63B 67/10; F41J 7/00

[52] U.S. Cl. ..... 273/333; 273/447; 273/348.4; 273/384; 446/310; 446/311

[58] Field of Search ..... 273/445–448, 273/345–347, 140; 446/310–311

[56] References Cited

U.S. PATENT DOCUMENTS

| | | | |
|---|---|---|---|
| 202,990 | 4/1878 | Chinnick | 446/311 |
| 3,463,494 | 8/1969 | Stroh | 273/448 X |
| 3,501,861 | 3/1970 | Goldfarb et al. | 446/311 X |
| 3,545,750 | 12/1970 | Stachnik, Sr. | 273/1 |
| 3,572,715 | 3/1971 | Ramirez | 446/310 X |
| 3,628,792 | 12/1971 | Frederick | 273/1 M |
| 3,788,641 | 1/1974 | Lemelson | 273/448 |
| 3,888,489 | 6/1975 | Kane | 273/134 B |
| 4,118,026 | 10/1978 | Todokoro | 273/447 |
| 4,165,075 | 8/1979 | Popovich | 273/140 |
| 4,976,439 | 12/1990 | Traemer | 273/140 X |
| 5,094,461 | 3/1992 | Lowrance | 273/343 |
| 5,314,182 | 5/1994 | Derr | 273/140 |
| 5,335,911 | 8/1994 | Brown | 273/140 |

*Primary Examiner*—Paul E. Shapiro
*Attorney, Agent, or Firm*—Frank J. Dykas

[57] ABSTRACT

A board game in which the object involves fishing for a prize, in which fish spring into the air when contacted and becomes attached to the "lure" on the fishing string and rod, and teaches a beginning fisherman how to cast and retrieve using an actual fishing rod and reel.

18 Claims, 10 Drawing Sheets

LEAPING FISH GAME AND TRAINING AID

BACKGROUND OF THE INVENTION

1. Technical Field

The present invention generally relates to board games, and more particularly to board games in which a fishing rod is used to catch fish which spring off the board. The invention further relates to devices for practicing casting and retrieving skills.

2. Background

Board games for fishing are known. Some of these games include the use of dice as part of the board game. Some use a simulated fishing rod to strike at and pick up objects. In others, game tokens are retrieved using magnets. What is not taught by any board games or fishing simulations is a board game in which the fish or other game pieces leaps off of the board as though it were a fish leaping out of the water. Another thing that is not shown in other board games is the hooking and capturing of a fish which subsequently leaps off the board game. Another feature which is not shown in other board games is the use of a functional fishing rod and reel. Another feature which is not shown in other games is the option of using a functional rod and reel to learn and practice skills of casting and retrieval in conjunction with a game.

DISCLOSURE OF INVENTION

Accordingly, it is an object of this invention to provide a board game which involves fishing for a prize.

Another object of the invention is to provide a board game in which fish spring into the air when contacted. A further object of the invention is to provide a board game which is made interesting to the user because when a fish is contacted it both leaps into the air and becomes attached to the "lure" on the fishing string and fishing rod. Another object of the invention is to provide a game which teaches a beginning fisherman how to cast and retrieve using an actual fishing rod and reel.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities combination particularly pointed out in the appended claims.

According to the present invention, the foregoing and other objects and advantages are obtained by a board game for playing. The board game includes a game board, one or more springing game pieces which are used on the game board, one or more positions on the game board which are for the placement of the springing game pieces, one or more springs which propel the springing game pieces from the positions on the game board, a way to place the springing game board pieces into positions on the board, a way to hold the springing game pieces on the positions from which they can be released, a way to release the springing game pieces from the positions on the game board, and a way to capture the springing game pieces from the positions on the game board.

In another version of the board game described above, the springs are part of the springing game pieces. The springing game pieces can be in the form of fish shapes or other shapes. The positions described above are recessed within the game board. A way to hold the springing game pieces in place while still allowing them to be released is a hinged door. A surface of the springing game piece protrudes through the hinged door. The hinged door allows the springing game piece to be held in position while the hinged door is swung closed. The board game may also include magnets for holding the hinged door shut and releasing the hinged door. A way to release the springing game pieces from the positions on the game board can be contact with an object. A way to capture the springing game pieces can be attachment to an object. The springing game pieces can be placed into position using a loading tube. The loading tube can be a cylinder with a finger slot. The object which contacts, releases, and captures the springing game piece can be a ball attached to a rod. The means for attachment of the object to the springing game pieces can be corresponding hook and loop surfaces on the object and the springing game pieces.

Another version of the board game for playing includes a game board for playing the board game, one or more springing game pieces which are used on the game board, one or more recessed positions on the game board for placement of the springing game pieces, one or more springs in the springing game pieces which propel the springing game pieces from the positions on the board, a loading tube for placing the springing game pieces into positions, and a hinged door which holds the springing game pieces in their position, but allows their release. The hinged door is built so that a surface of the springing game piece protrudes through the door. The hinged door is built to allow the surface of the springing game piece to be held in place as the hinged door is closed. There are one or more magnets which hold the hinged door closed, and a ball attached to a rod with a string, for contacting the springing game pieces. There is provided a way to release the springing game pieces from the position, and a way to capture the springing game pieces.

In the board game described above, a way to capture the springing game pieces can be a pair of corresponding hook and loop surfaces on the springing game pieces and the object, and the ball. In this version, the springing game pieces can be in the form of fish shapes.

The invention thus provides a board game in which pieces of the board game spring from recessed positions on the game board and are captured by a game player using a rod with an attached "lure" on a string. When the "lure" contacts the nose of a fish which is protruding from the hinged door, the rebound from this impact causes the hinged door to break free of the magnet and spring open from the force of the compressed spring of the springing game piece. The Velcro® surface on the nose of the springing game piece may become attached to the Velcro® surface (or the hook and loop surface) on the ball which is the "lure". The game board can be used for casting practice and retrieval using a functional fishing rod, reel and line.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of modifications in various obvious respects, all without departing from the invention. Accordingly, the drawings and description are to be regarded as illustrative in nature and not as restrictive.

BEST MODE FOR CARRYING OUT INVENTION

Figure 1:
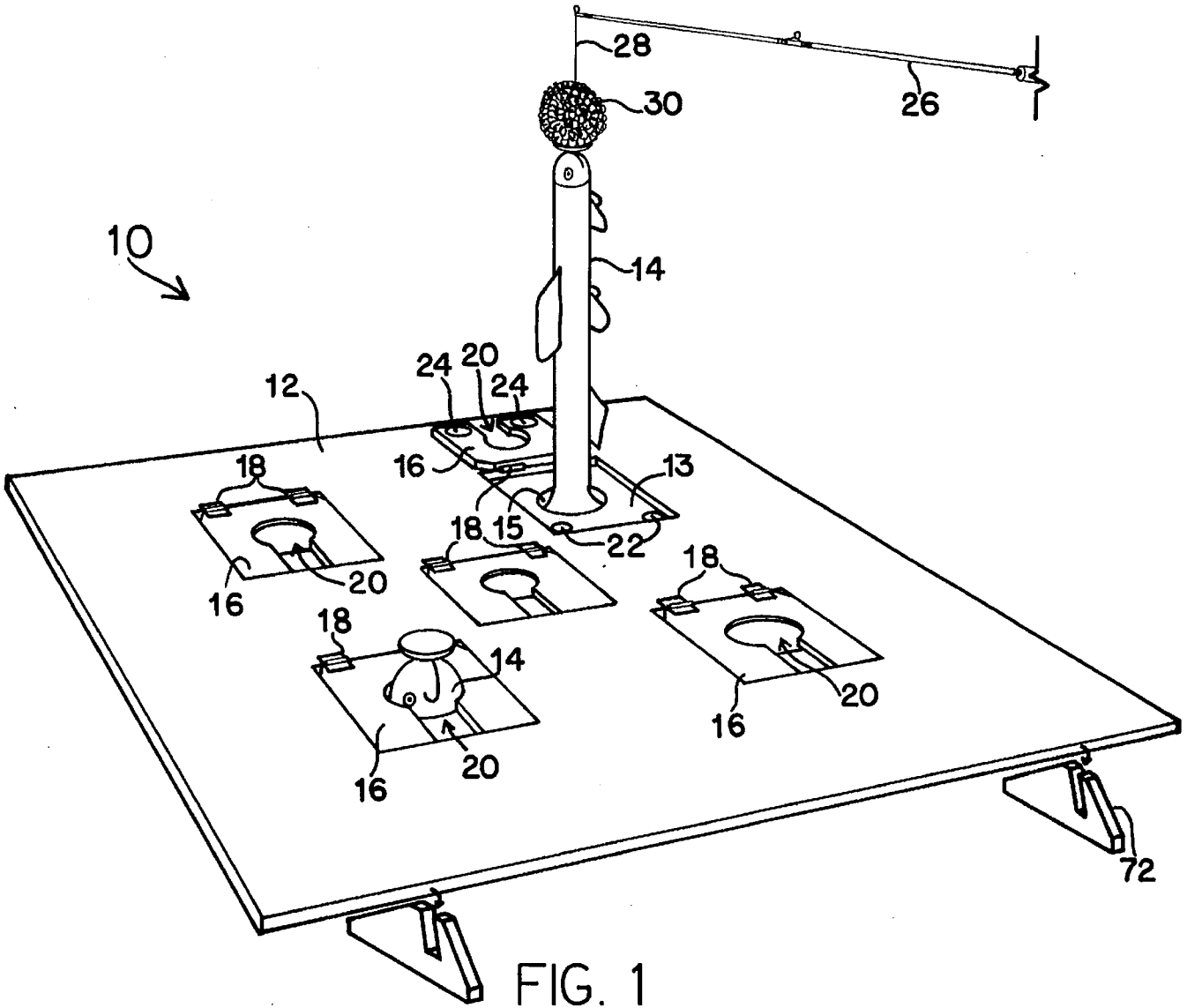
FIG. 1 is a perspective view of the board game.
Figure 2:
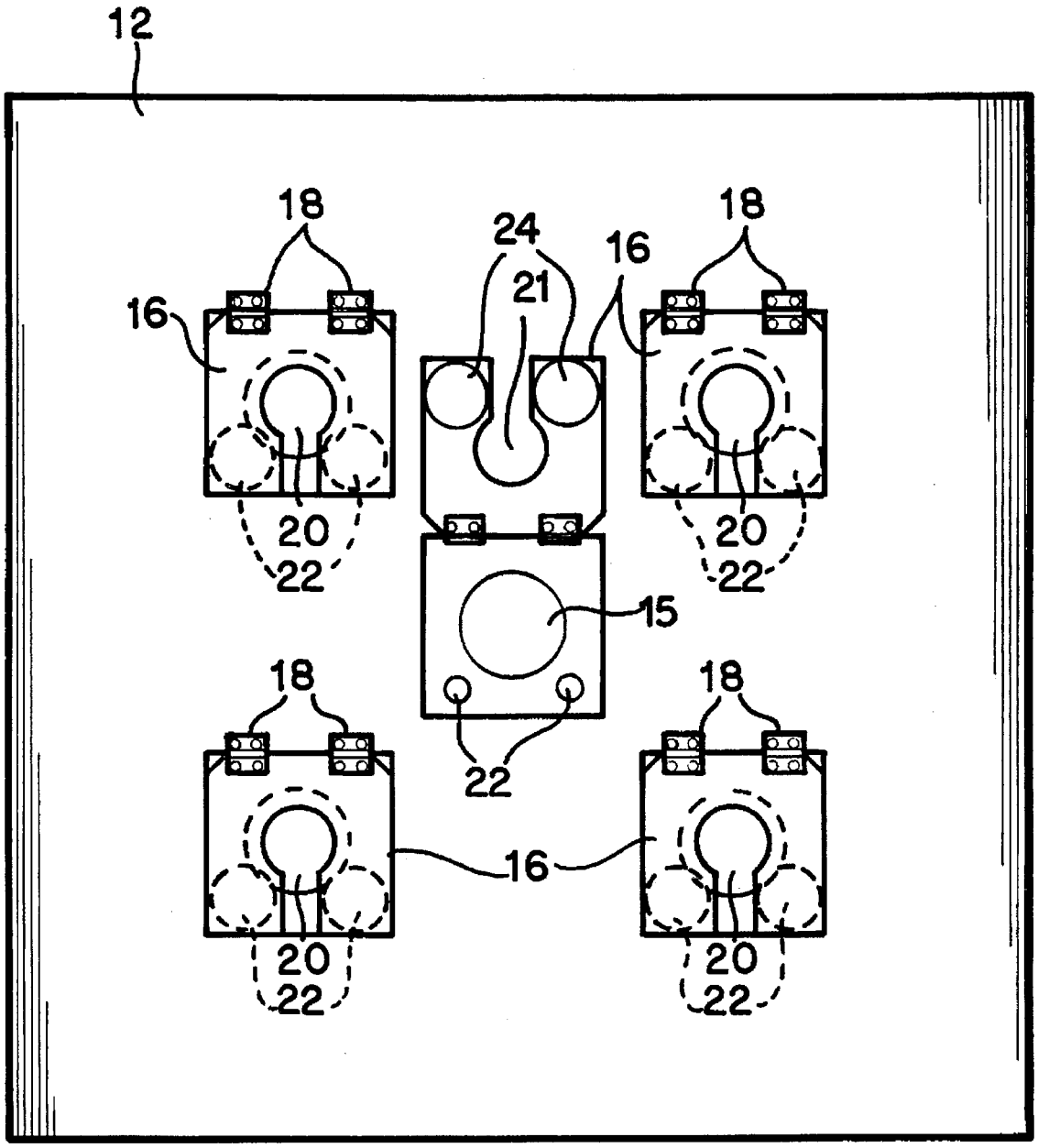
FIG. 2 is a top view of the game board.

The board game and its pieces are shown in FIGS. 1 through 6. The game board 12 is a generally rectangular board. In the best mode, it is approximately 20" by 20" and ¾" thick, as shown in FIGS. 1 and 2. On the game board are located five positions 15 for the placement of springing game pieces 14. Each position 15 is covered by a hinged door 16. Each hinged door 16 is approximately 4" by 4", and approximately ⅜" in thickness. The game board 12 and the hinged doors 16 can be made of wood, paper, plastic, metal or any other suitable material.

Figure 3:
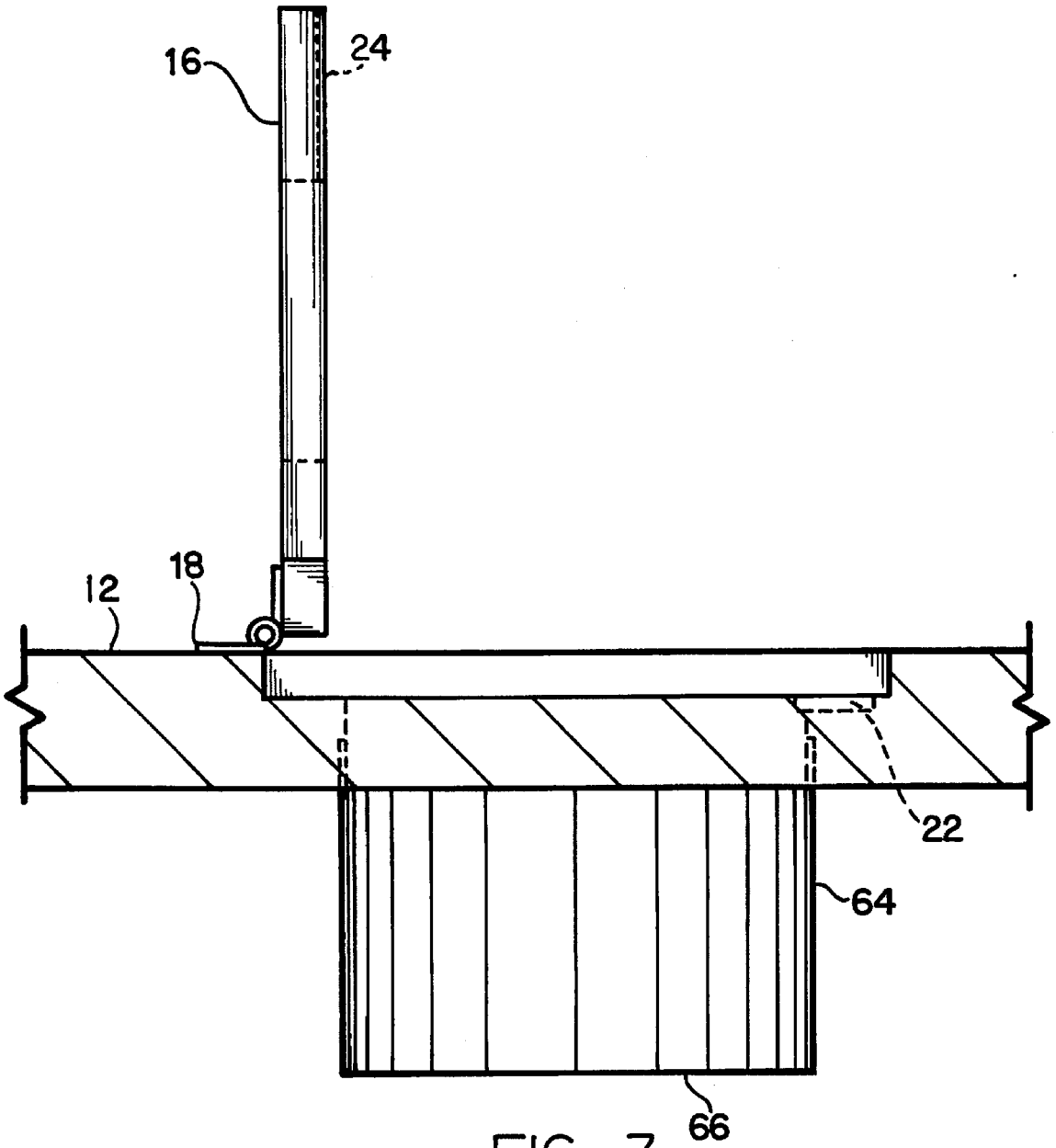
FIG. 3 is a side view of the game board, hinged door, and position.

Positions 15 are cylindrical containers which are recessed below the top surface 68 of the game board 12, as shown in FIG. 3. They are approximately 2¼" deep, and 2¾" in diameter.

Figure 4:
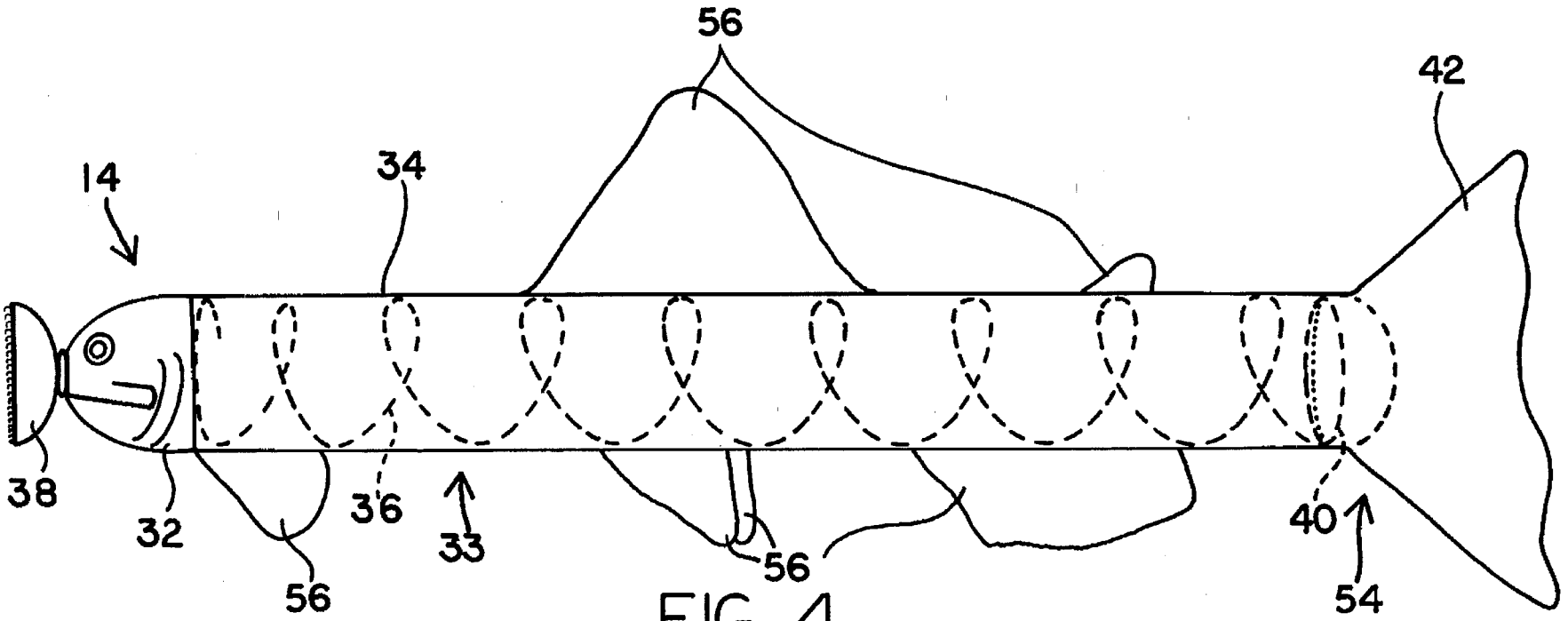
FIG. 4 is a side view of the springing game piece.

The springing game piece 14, as shown in FIG. 4, is a generally cylindrical structure which, when unbiased, is approximately 22" in length and 2" in diameter. The springing game piece has a fish head 32, a contact surface 38, and a suction cup 52. The fish head 32 is a conical shape as shown in FIG. 4. It has a smooth surface, and is designed to slip easily from centering cone 20, and through loading slot 21 when the hinged door 16 opens. Suction cup 52 is made of rubber, and contact surface 38 is covered with a hook surface. The concave shape of contact surface 38 is important in ensuring more connections between the contact surface 38 and ball 30. The rubber material of the suction cup 52 makes injury to a game user less likely. Attached to the fish head 32 of the springing game piece 14 is an internal spring 36. At the end of the spring 36 opposite the fish head 32 is tail end 54. Internal spring 36 is covered by body sleeve 34, which is a cylindrical sleeve of fabric or other suitable material which covers internal spring 36. At tail end 54 of internal spring 36 is located foam pad 40, which is attached to tail end 54 of internal spring 36. Body sleeve 34 extends beyond foam pad 40 and ends in tail 42. Foam pad 40 serves to create a tapered fish body from the end of internal spring 36 to tail end 54. Along the length of body sleeve 34 are located fins 56 which simulate fish fins.

Figure 5:
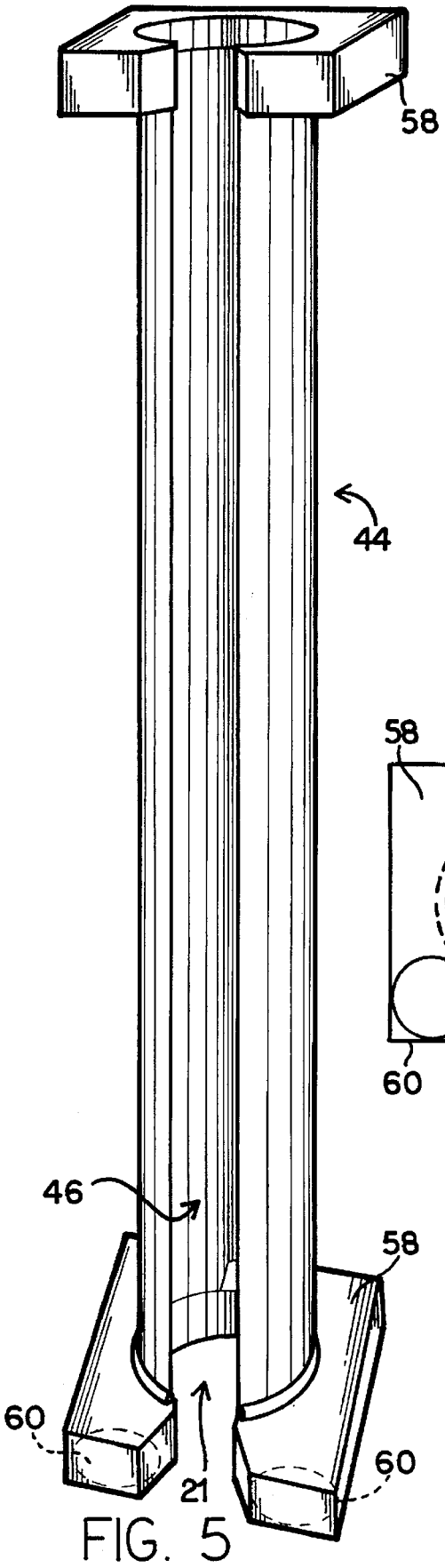
FIG. 5 is a perspective view of the loading device.

Loading tube 44 is a generally cylindrical device, as shown in FIG. 5. It is approximately 20" long and 2½" in diameter. It has a longitudinal axis. Parallel with the longitudinal axis is a compression slot 46 which runs the length of loading tube 44. At each end of loading tube 44 is attached a shoe 58. Mounted in shoe 58 are steel discs 60. Parallel to the longitudinal axis of the loading tube and opposite the finger slot is fin channel 62.

Figure 7:
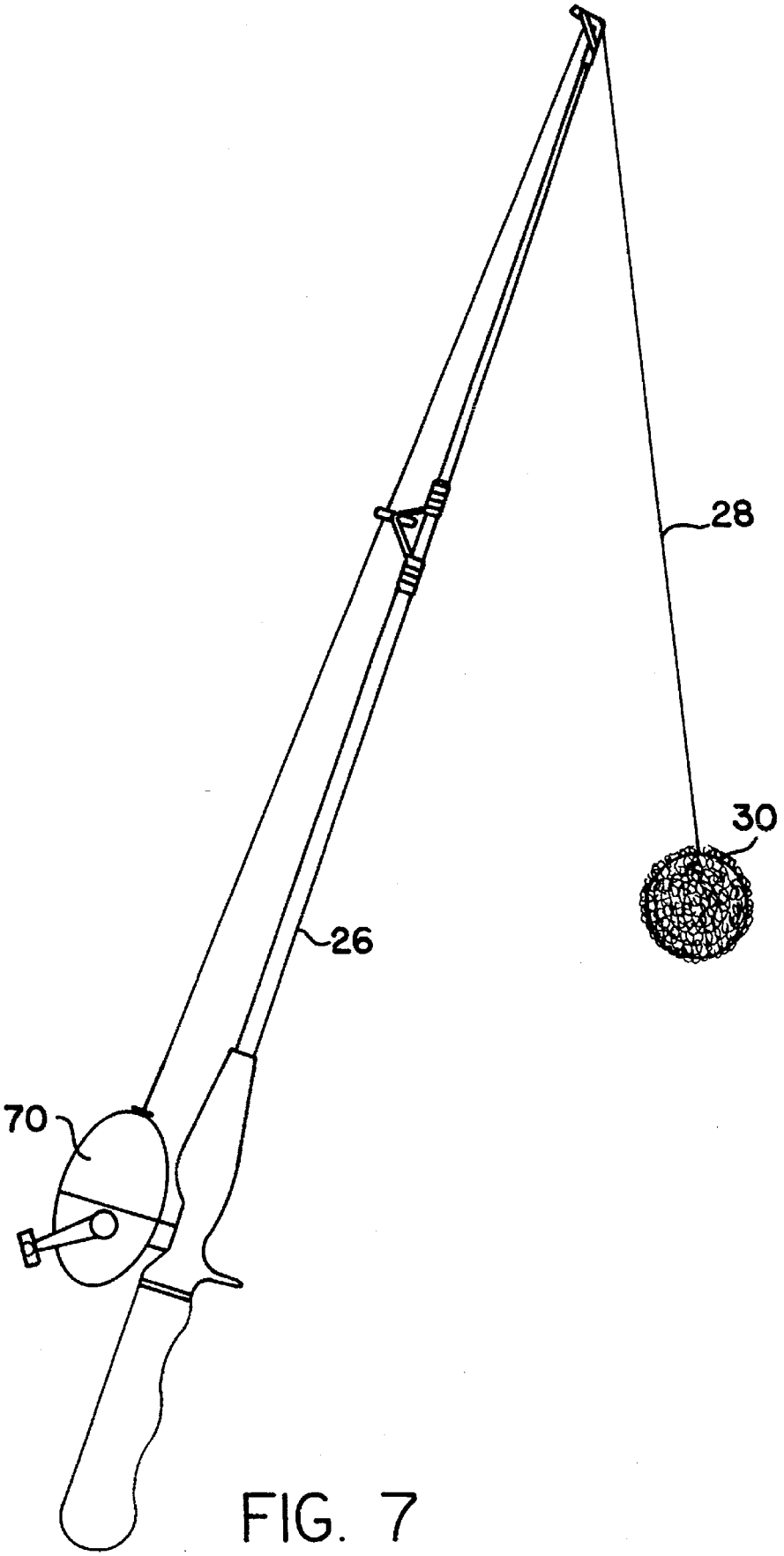
FIG. 7 is a side view of the rod, reel, string and lure.

Ball 30 acts as a "lure" in the fishing game. It is attached to string 28, as shown in FIG. 7. In the best mode, string 28 is wound on reel 70, which is itself mounted on rod 26. Ball 30 is covered by a "loop" surface, to interact and attach to a "hook" surface.

Figure 8A:
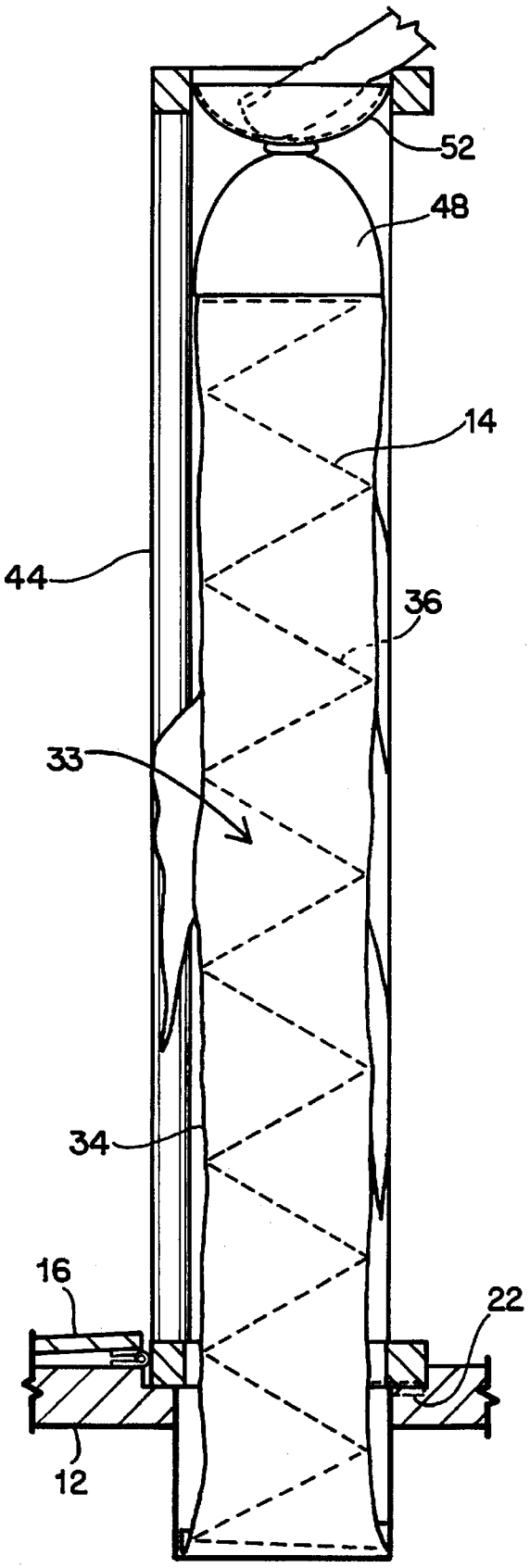
FIG. 8A is a cut-away cross-sectional view of the game board, the springing game piece, and the loading device.
Figure 8B:
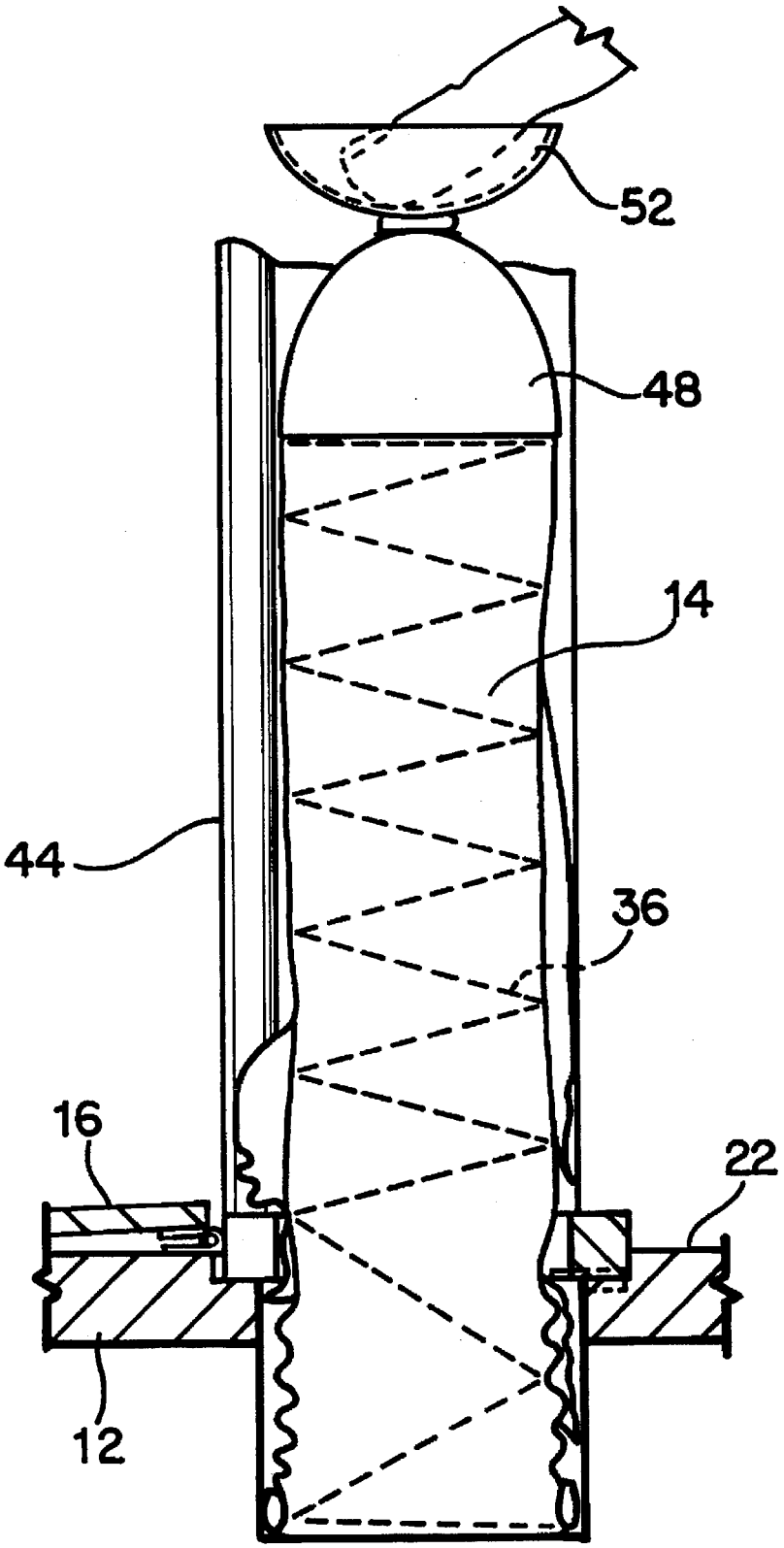
FIG. 8B is a cut-away cross-sectional view of the springing game piece being loaded.
Figure 8C:
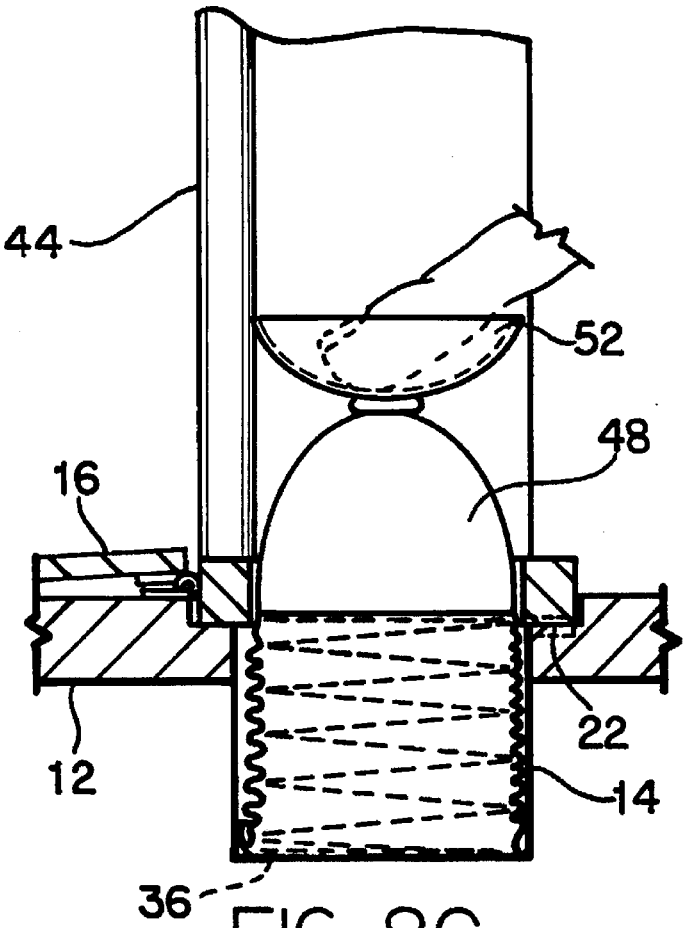
FIG. 8C is a cut-away cross-sectional view of the springing game piece being loaded.
Figure 8D:
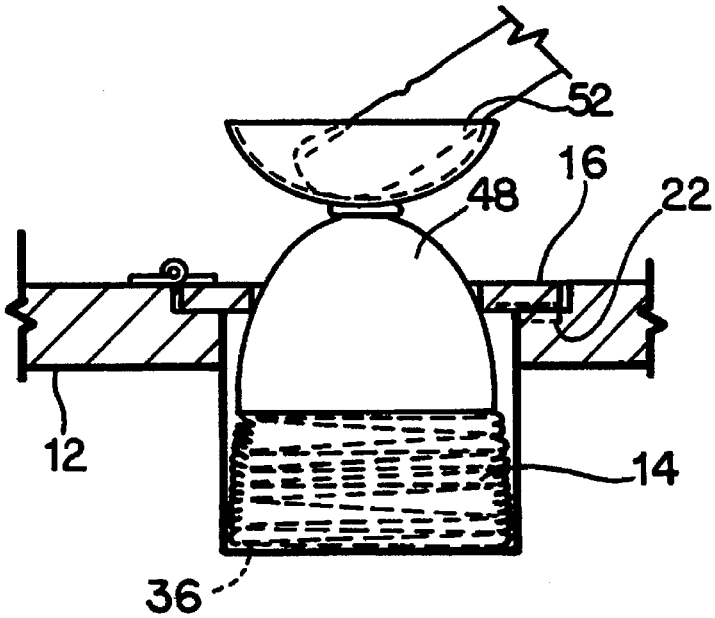
FIG. 8D is a cut-away cross-sectional view of the game board being loaded.
Figure 8E:
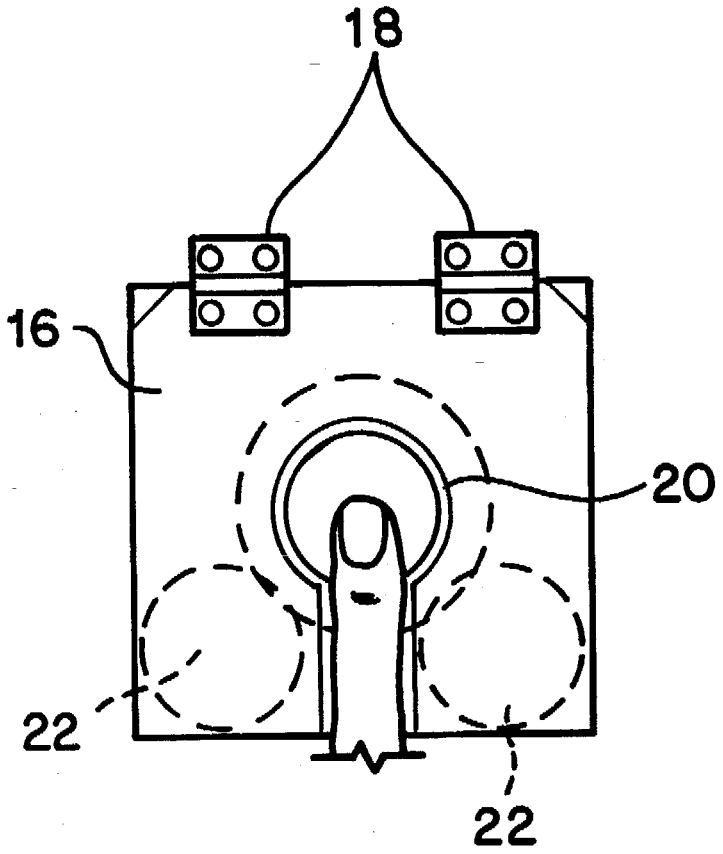
FIG. 8E is a top view showing the closing of the hinged door over the springing game piece.

Hinged doors 16 are attached to the game board 12 by hinges 18, as shown in FIG. 3. These are placed so that the hinged doors 16 fill the recesses 13 when closed and uncover recesses 13 when opened. Inside recesses 13 are located positions 15. These are cylindrical walled structures which extend from the surface of recesses 13 to a depth of about 2½". Positions 15 have a side wall 64 and an end plate 66. In the corners of recess 13 opposite hinges 18 are located two magnets 22 as shown in FIGS. 2 and 3. Hinged door 16 has a semi-circular tapered inner wall which delineates a centering cone 20 and a loading slot 21, as shown in FIG. 8E.

Figure 6:
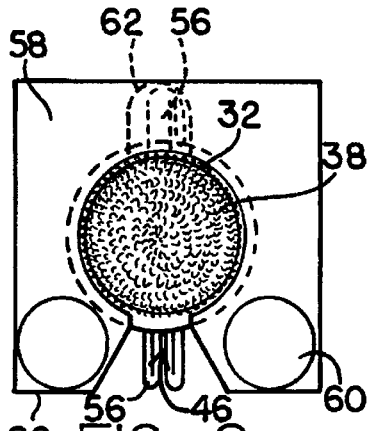
FIG. 6 is a top view of a hinged door with a springing game piece visible.

To play the game, the springing game pieces 14 are first placed in positions 15. To do this, hinged doors 16 are opened. Next, the shoe 58 of loading tube 44 is placed in recess 13. In that position, the steel plates 60 of shoe 58 are attracted by magnets 22, and thus held in place. Next, a springing game piece 14 is inserted into loading tube 44, so that the body 33 of the springing game piece 14 is inside loading tube 44. This is shown in FIG. 8A. The fins 56 of springing game piece 14 are positioned so that they are either in fin channel 62 or extend from compression slot 46, as illustrated in FIG. 6. Tail end 54 of springing game piece 14 is in contact with end plate 66 of position 15, as shown in FIG. 8A. The user places a finger or other loading device on contact surface 38 and presses down. As the user continues to press down, internal spring 36 is compressed, body sleeve 34 folds and fish body 33 becomes shorter. The progressive shortening of the fish body 33 by pressing on contact surface 38 is shown in FIGS. 8A, 8B, 8C and 8D. When the fish body 33 is fully enclosed within position 15, the user removes loading tube 44 while maintaining pressure with a finger against contact surface 38. With a finger still on contact surface 38, the user closes hinged door 16 until magnets 22 in the recess contact steel plates 24 in the hinged door, as shown in FIG. 7D. The user can keep one finger on contact surface 38 while hinged door 16 closes, due to loading slot 21 in the hinged door 16, as shown in FIG. 8E.

When all of the positions 15 are loaded with springing game piece 14 and all of the hinged doors 16 are closed and held by magnets 22, the game can begin.

To play the game, the user grasps rod 26 from which is suspended string 28 and ball 30 from reel 70. The ball acts as the "lure" in the fishing game. The user casts the "lure" at the game board and attempts to contact one of the exposed contact surfaces 38 of springing game piece 14. When the ball 30 contacts contact surface 38 of a springing game piece 14, the impact of the contact can momentarily further depress internal spring 36. When internal spring 36 rebounds from this contact, the force of the rebound overcomes the attraction of magnets 22 to steel plates 24, and hinged door 16 pops open from the force of internal spring 36. As hinged door 16 swings away from recess 13, internal spring 36 continues to expand and springing game piece 14 shoots from position 15. If the contact between ball 30 and contact surface 38 is sufficient, the hook surface of contact surface 38 interacts with the loop surface of ball 30 and the "fish" is effectively "hooked". The "hooked" springing game piece 14 can be reloaded using loading tube 44 for continued play, or play can continue until all of the springing game pieces 14 have been "hooked".

One preferred method of playing the game involves the use of a functional fishing rod 26 and reel 70. The game board 12 can be placed at an appropriate distance for the skill of the fisherman. The fisherman then uses the rod 26 and the reel 70 to cast the string 28 and the "lure" ball 30 to strike at the contact surfaces 38 which protrude from the hinged doors 16 which are on the surface of the game board 12. When used as a casting target in this manner, the board dame can be placed in a slanted position in stand 72, shown in FIG. 1. When used in this manner, a beginning fisherman can use an actual rod and reel to learn how to cast and retrieve. A more experienced fisherman can position the board game and practice aid 10 at a further distance and both entertain himself and practice the skills of casting and retrieving.

While there is shown and described the present preferred embodiment of the invention, it is to be distinctly understood that this invention is not limited thereto but may be variously embodied to practice within the scope of the following claims.

I claim:

1. A board game for playing, comprising;

a game board for playing the board game;

a plurality of springing game pieces which are used on the game board;

a plurality of positions on said game board for placement of the said springing game pieces;

a plurality of springs which propel the said springing game pieces from the said positions on said game board;

a means of placing said springing game pieces into said positions on said game board;

a means of releasably holding said springing game pieces on said positions;

a means of releasing said springing game pieces from said positions on said game board;

a means of capturing said springing game pieces from said positions on said game board.

2. A board game for playing as recited in claim 1, wherein said springs are incorporated into the structure of said springing game pieces.

3. A board game for playing as recited in claim 1, wherein said springing game pieces are in the form of fish shapes.

4. A board game for playing as recited in claim 1, wherein said positions are recessed within said game board.

5. A board game for playing as recited in claim 1, wherein the means of releasably holding the springing game pieces is a hinged door.

6. A board game for playing as recited in claim 5, wherein said hinged door allows a surface of said springing game piece to protrude.

7. A board game for playing as recited in claim 5, wherein said hinged door allows said surface of said springing game piece to be held in position while said hinged door is closed.

8. A board game for playing as recited in claim 5, which further comprises magnets for holding and releasing said hinged door.

9. A board game for playing as recited in claim 1, wherein the means of releasing said springing game pieces from the positions on the game board is said contact with an object.

10. A board game for playing as recited in claim 1, wherein the means of capturing said springing game pieces is attachment to an object.

11. A board game for playing as recited in claim 10, wherein said object is a ball attached to a rod.

12. A board game for playing as recited in claim 10, wherein the means of attachment of said springing game pieces to said object is a corresponding hook and loop surface on said springing game pieces and said object.

13. A board game for playing as recited in claim 1, wherein the means of placing said springing game pieces into position is a loading tube.

14. A board game for playing as recited in claim 8, wherein said loading tube is a cylinder with a finger slot.

15. A board game for playing, comprising;

a game board for playing said board game;

a plurality of springing game pieces which are used on said game board;

a plurality of recessed positions on said game board for placement of said springing game pieces;

a plurality of springs in said springing game pieces which propel said springing game pieces from the positions on said game board;

a loading tube for placing said springing game pieces into said positions;

a hinged door which releasably holds said springing game pieces in their positions, from which a surface of said springing game piece protrudes, and which allows said surface of said springing game piece to be held in place as said hinged door is closed;

a plurality of magnets which hold said hinged door closed;

a ball attached to a rod with a string, for contacting said springing game pieces;

a means of releasing said springing game pieces from said positions;

a means of capturing said springing game pieces.

16. A board game for playing as recited in claim 15, wherein the means of capturing said springing game pieces is a pair of corresponding hook and loop surfaces on said springing game pieces and said ball.

17. A board game for playing as recited in claim 15, wherein said springing game pieces are in the form of fish shapes.

18. A board game for playing as recited in claim 15 which further comprises a fishing reel which is mounted on the said rod.

* * * * *